US009429360B2

(12) United States Patent
Hsiao et al.

(10) Patent No.: US 9,429,360 B2
(45) Date of Patent: Aug. 30, 2016

(54) ELECTRICAL CONNECTOR WITH HEATING DEVICE

(71) Applicant: FOXCONN INTERCONNECT TECHNOLOGY LIMITED, Grand Cayman (KY)

(72) Inventors: Yu-San Hsiao, New Taipei (TW); De-Jin Chen, ShenZhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/812,729

(22) Filed: Jul. 29, 2015

(65) Prior Publication Data

US 2016/0033198 A1 Feb. 4, 2016

(30) Foreign Application Priority Data

Jul. 30, 2014 (CN) ..... 2014 2 0422977 U

(51) Int. Cl.

| | |
|---|---|
| ***H01R 13/648*** | (2006.01) |
| ***F26B 3/28*** | (2006.01) |
| ***H01R 13/52*** | (2006.01) |
| ***H01R 43/20*** | (2006.01) |
| ***H01R 24/60*** | (2011.01) |
| ***H01R 13/66*** | (2006.01) |
| *H01R 107/00* | (2006.01) |

(52) U.S. Cl.

CPC ..... *F26B 3/28* (2013.01); *H01R 13/5202* (2013.01); *H01R 13/6608* (2013.01); *H01R 24/60* (2013.01); *H01R 43/20* (2013.01); *H01R 2107/00* (2013.01)

(58) Field of Classification Search

CPC ..... H01R 23/7073; H01R 23/688; H01R 23/6873; H01R 13/65802; H01R 23/7068

USPC ..... 439/79, 101, 108, 607.08–607.11, 439/607.35–607.37, 607.4, 629, 660

See application file for complete search history.

(56) References Cited

U.S. PATENT DOCUMENTS

| | | | | |
|---|---|---|---|---|
| 8,827,742 | B2 * | 9/2014 | Wang | H01R 24/68 439/569 |
| 8,851,927 | B2 * | 10/2014 | Hsu | H01R 13/6594 439/607.11 |
| 8,956,187 | B2 * | 2/2015 | He | H01R 13/504 439/607.35 |
| 9,088,108 | B2 * | 7/2015 | Zhao | H01R 13/6581 |
| 9,093,797 | B2 * | 7/2015 | Zhao | H01R 12/707 |
| 9,190,765 | B2 * | 11/2015 | Chang | H01R 13/6581 |
| 9,281,643 | B1 * | 3/2016 | Tseng | H01R 13/518 |

FOREIGN PATENT DOCUMENTS

| | | |
|---|---|---|
| CN | 20169004 | 12/2010 |

* cited by examiner

*Primary Examiner* — Thanh Tam Le

(74) *Attorney, Agent, or Firm* — Wei Te Chung; Ming Chieh Chang

(57) ABSTRACT

An electrical connector includes an insulative housing with a plurality of contacts therein and a metallic shell enclosing said housing to form a mating cavity in which the contacting sections of the contacts are exposed upon a mating tongue of the housing, which extends in the mating cavity. A heating device is retained in the housing and located adjacent to the contacting sections of the contacts to expel humidity therefrom and away from the mating cavity.

9 Claims, 6 Drawing Sheets

ELECTRICAL CONNECTOR WITH HEATING DEVICE

BACKGROUND OF THE INVENTION

1. Field of the Invention

The present disclosure relates to an electrical connector, and particularly to the electrical connector with a heating device to remove humidity therefrom.

2. Description of Related Art

China Utility Patent No. CN201020192747.9 discloses an electrical connector including an insulative housing with a plurality of contacts therein, and a metallic shell enclosing said housing to form a mating cavity in which the contacting sections of the contacts are exposed. Anyhow, there is no proper protection in front of the mating cavity to prevent moisture from entering the mating cavity, which may short the contacting sections of the neighboring contacts, thus jeopardizing the quality and security of the whole electrical connector.

In view of the above, an improved antenna is desired to overcome the problems mentioned above.

SUMMARY OF THE INVENTION

Accordingly, an object of the present disclosure is to provide an electrical connector which may sense humidity in the mating cavity and expel such humidity therefrom in time, thus avoiding shorting thereof.

According to one aspect of the present disclosure, an electrical connector includes an insulative housing with a plurality of contacts therein and a metallic shell enclosing said housing to form a mating cavity in which the contacting sections of the contacts are exposed upon a mating tongue of the housing, which extends in the mating cavity. A heating device is retained in the housing and located adjacent to the contacting sections of the contacts to expel humidity therefrom and away from the mating cavity.

Other objects, advantages and novel features of the disclosure will become more apparent from the following detailed description when taken in conjunction with the accompanying drawings.

DETAILED DESCRIPTION OF THE INVENTION

Figure 1:
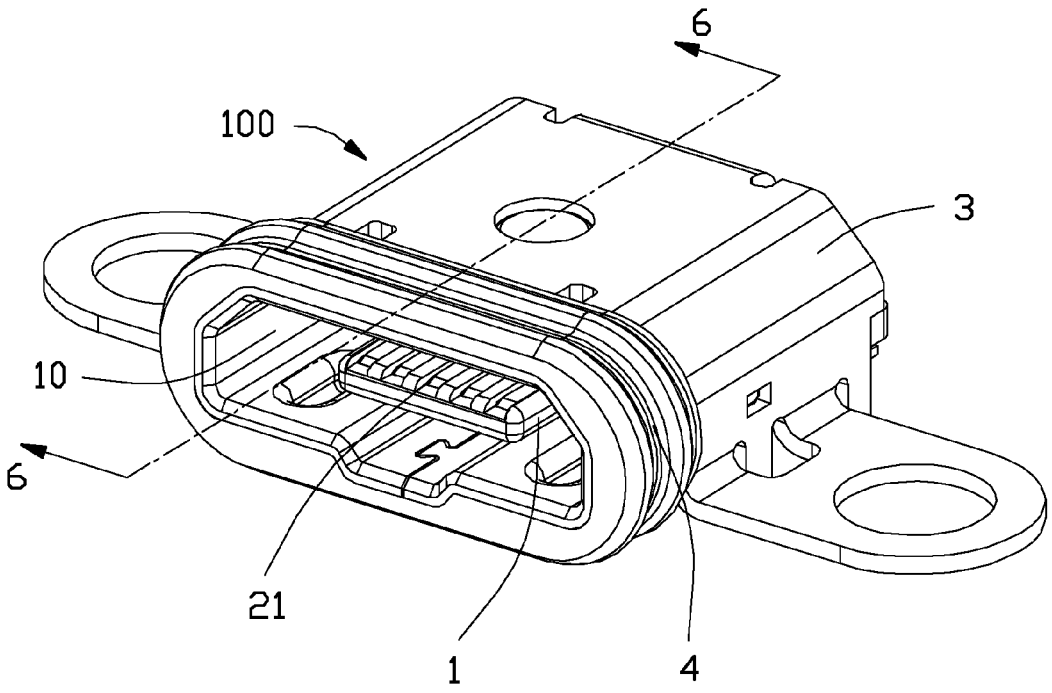
FIG. 1 is a front perspective view of an electrical connector in accordance with a preferred embodiment of the present disclosure.
Figure 2:
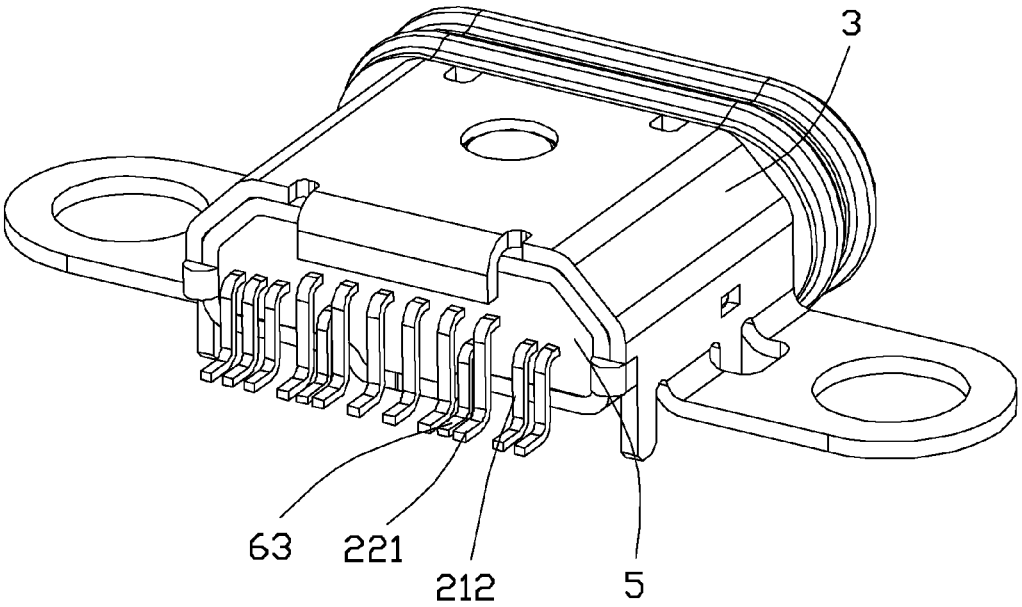
FIG. 2 is a rear perspective view of the electrical connector of FIG. 1.
Figure 3:
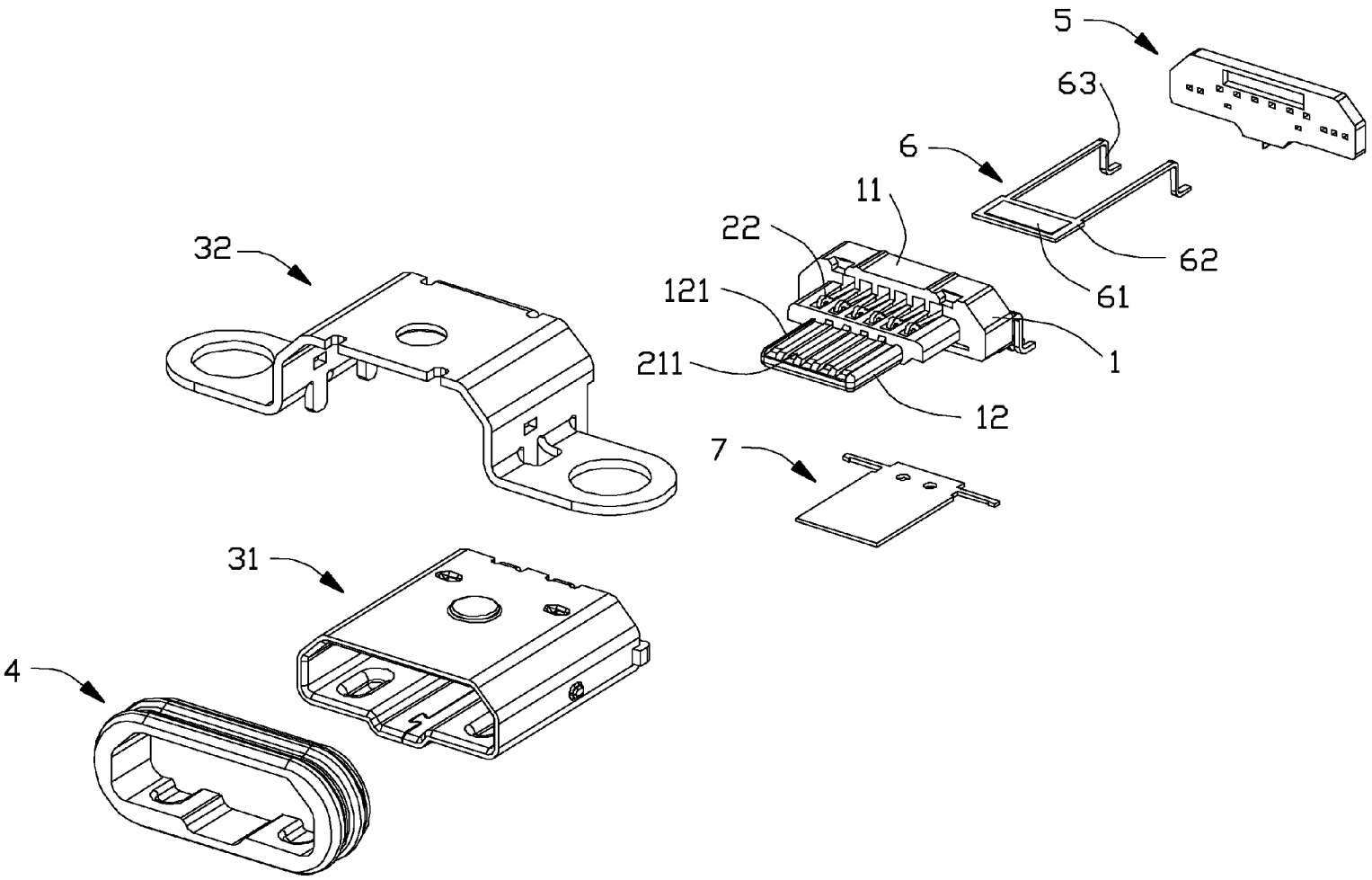
FIG. 3 is a front exploded perspective view of the electrical connector of FIG. 1.

Reference will now be made to the drawings to describe a preferred embodiment of the present disclosure in detail.

Referring to FIGS. 1-3 and 6, an electrical connector 100, which may sense invading humidity and successively heat and dry the contacting sections of the contacts in time for preventing shorting thereof, includes an insulative housing 1 and the contacts retained to the housing 1, and a metallic shell 3 enclosing the housing 1 to form the mating cavity 10. The contacts include a plurality of first contacts 21 and a plurality of second contacts 22 wherein the first contact 21 includes a front first contacting section 211 exposed upon a mating tongue 12 of the housing 1, and a rear first connecting section 212 exposed outside of the housing 1.

The housing 1 includes a base 11 from which the mating tongue 12 forwardly extends. The mating tongue 12 forms opposite surfaces 121 and 122 wherein the first contacting sections 211 are exposed upon the first surface 121. A metallic reinforcement plate 7 is insert-molded in the housing 1 and exposed upon the second surface 122 opposite to the first contacting sections 211 for enhancing the structure of the mating tongue 12. Further referring to FIG. 6, a heating device 6 is insert-molded within the housing 1 and includes a heating fin 61 equipped with the sensor (not shown) to sense the humidity thereabouts and generating heat to dry and expel such humidity therefrom. In this embodiment, the heating fin 61 essentially located within the mating tongue 12; anyhow the mating tongue 12 may be formed with recesses to allow the heating fin 61 to communicate with a mating cavity 10 around the first surface 121 and the second surface 122 so as to sensitively catch existence of the humidity thereabouts and successively dispatch the heat for drying. The heating device 6 further includes the connecting legs 63 for mounting to the printed circuit board to obtain the heat generating power, and a heating plate 62 connected to the connecting legs 63, on which the heating fin 61 is seated. Notably, the sensor may be separated from the heating fin 61.

In this embodiment, the second connecting sections 221 of the second contacts 22, the first connecting section 212 of the first contacts 21, and the connecting legs 63 of the heating device 6 are arranged in one row. The metallic shell 3 includes an enclosure 31 in which the mating cavity 10 is formed, and a bracket to and under which the enclosure 31 is attached. An inner seal 5 is located on a rear side of the housing 1 to avoid moisture invasion through the connector itself, and an outer seal 4 encloses the enclosure 31 to avoid moisture invasion through the gap between the connector and the opening of the panel of the computer enclosure in which the connector is located.

Notably, in this embodiment because the heating device is operated via electricity, it is improper to have the heating fin 61 directly contacts the reinforcement plate 7 if the reinforcement plate 7 is grounded. Accordingly, an insulative layer may be required to be sandwiched between the reinforcement plate 7 and the heat fin 61 for isolation therebetween.

Figure 4:
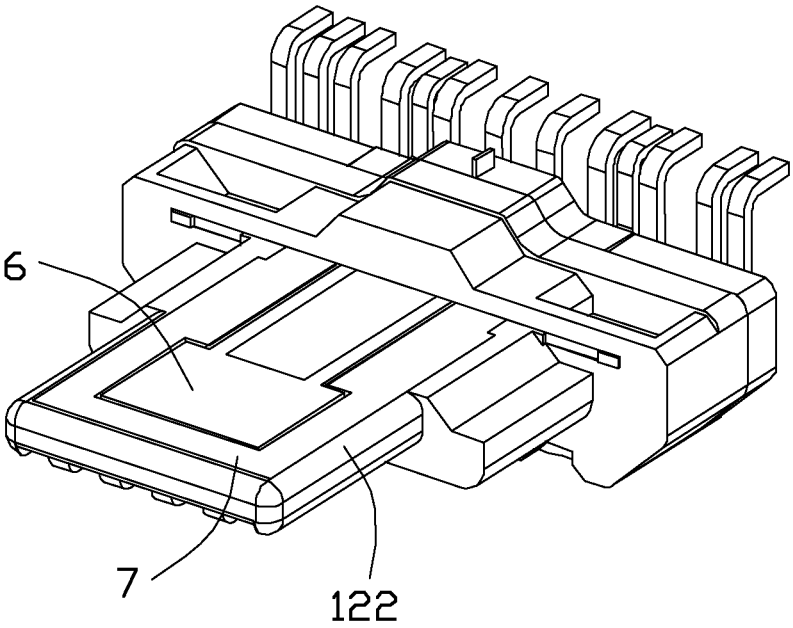
FIG. 4 is an upside-down front perspective view of the housing in accordance with another embodiment of the electrical connector of the instant invention.
Figure 5:
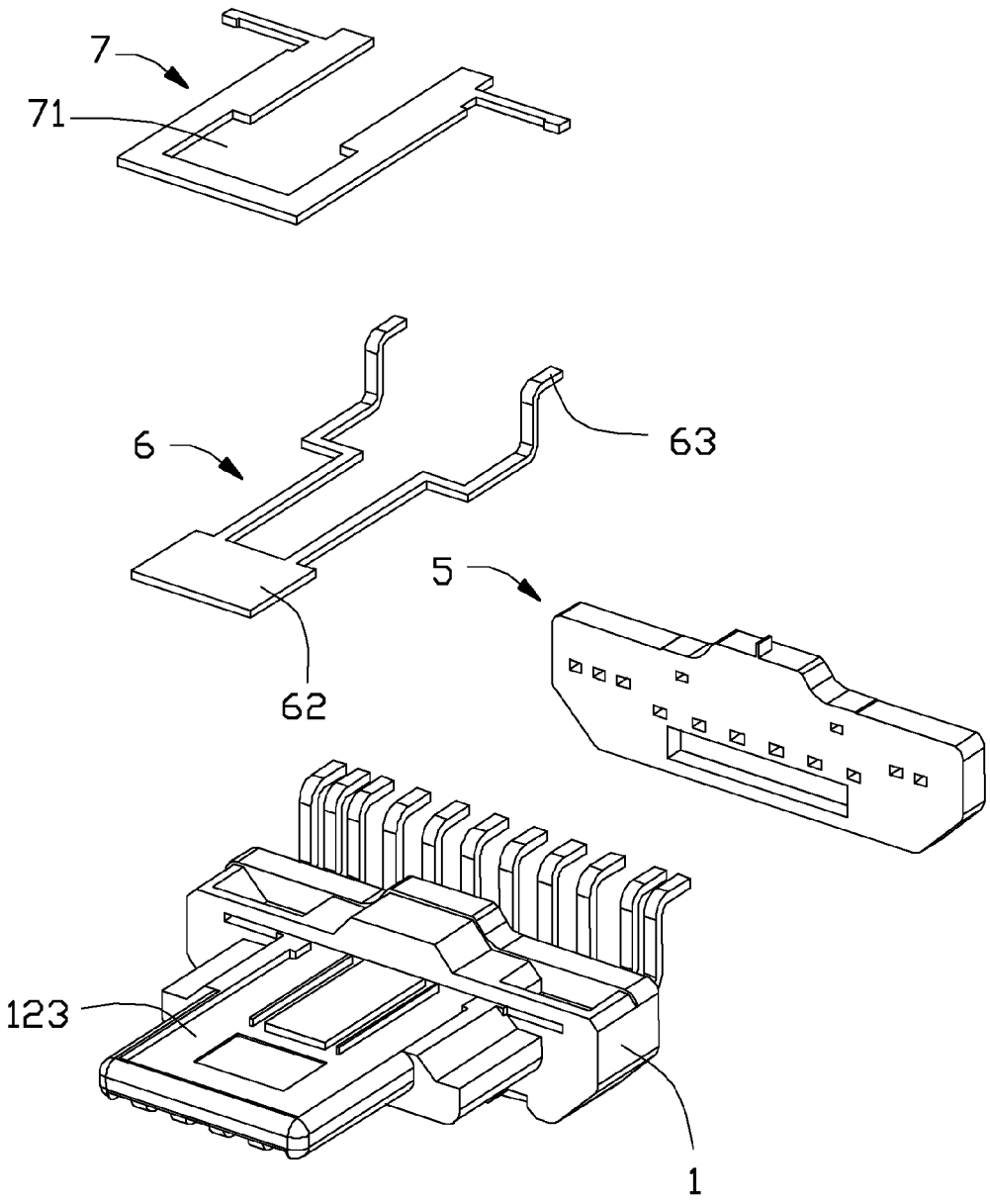
FIG. 5 is an upside-down front exploded perspective view of the electrical connector of FIG. 4.
Figure 6:
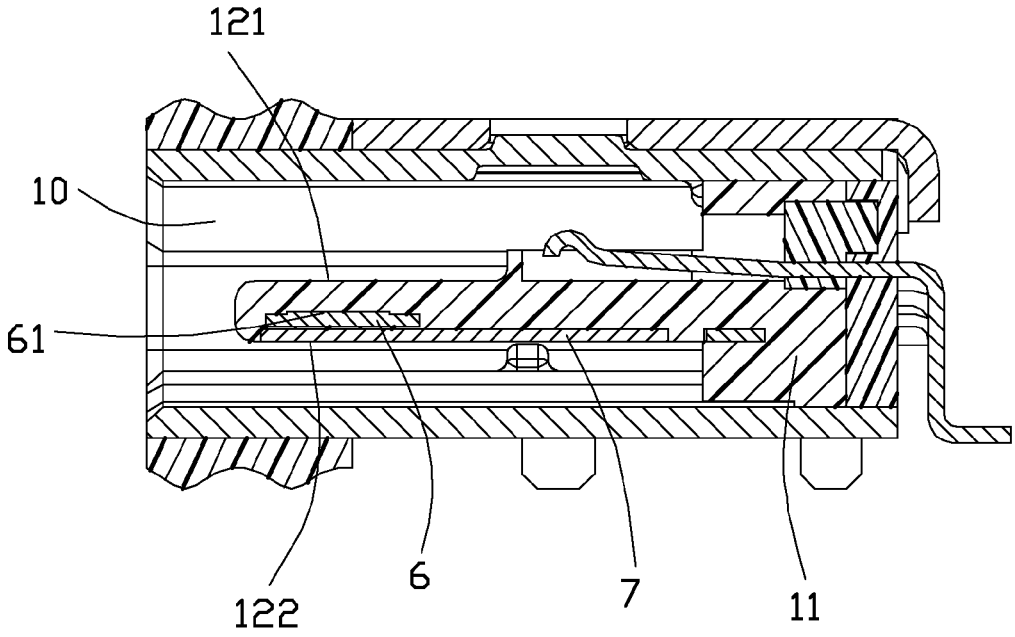
FIG. 6 is a cross-sectional view of the electrical connector of FIG. 1

Referring to FIGS. 4 and 5, the electrical connector of the second embodiment includes the similar structure with that of the first embodiment except that the heating fin and the reinforcement plate are arranged no long in a stacked manner but in a coplanar manner wherein a recess 123 is formed in the second surface 122 to receive the corresponding heating device 6 and the reinforcement plate 7 while the reinforcement plate 7 also forms an recession to receive the heating device 6 therein so as to have the heating device 6 is essentially located at a same level in a coplanar manner with the reinforcement plate 7. Notably, similar to the first embodiment, the heating device is essentially electrically isolated from the reinforcement plate 7.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector comprising:

an insulative housing including a base and a mating tongue extending forwardly therefrom in a front-to-back direction;

a plurality of contacts disposed in the housing with contacting sections exposed upon the mating tongue and connecting legs exposed outside of the housing; and a heating device embedded within the housing and including a heating fin located adjacent to the contacting sections to heat the contacting sections and remove moisture therefrom;

wherein the heating fin is spaced from the contacting sections in a vertical direction perpendicular to said front-to-back direction;

wherein the mating tongue defines opposite first and second surfaces thereon in the vertical direction, the contacting sections are exposed upon the first surface and a metallic reinforcement plate is located upon the second surface, and the heating fin is located between the contacting sections and the reinforcement plate in the vertical direction;

wherein said heating device includes a pair of connecting legs exposed outside of the housing beside the connecting sections of the contacts; and wherein the connecting legs and the connecting sections are arranged in one row in a transverse direction perpendicular to both said front-to-back direction and said vertical direction.

2. The electrical connector as claimed in claim 1, wherein the heating fin is closer to the reinforcement plate than to the contacting sections in the vertical direction.

3. The electrical connector as claimed in claim 2, wherein said heating fin is electrically isolated from the reinforcement plate in the vertical direction.

4. The electrical connector as claimed in claim 1, further including a seal covering a back side of the housing through which both said connecting legs and said connecting sections extend.

5. The electrical connector as claimed in claim 4, further including a metallic shell enclosing the housing, wherein the seal is attached to an interior surface of the shell around the back side of the housing.

6. The electrical connector as claimed in claim 1, wherein said pair of connecting legs are spaced from each other in a transverse direction perpendicular to both said front-to-back direction and said vertical direction.

7. The electrical connector as claimed in claim 6, wherein said pair of connecting legs are spaced from each other in said transverse direction with a distance essentially similar to a width of said mating tongue in said transverse direction.

8. An electrical connector comprising:

an insulative housing;

a metallic shell enclosing the housing to form a mating cavity to forwardly communicate with an exterior in a front-to-back direction;

at least one contact disposed in the housing with a front contacting section exposed in the mating cavity and a rear connecting section exposed outside of the housing; and a heating device retained by the housing and including a heating fin close to the contacting section to heat the contacting sections for removal moisture therefrom;

wherein the heating fin is spaced from the contacting section in a vertical direction perpendicular to the front-to-back direction;

wherein said heating device further includes a pair of connecting legs exposed outside of the housing and beside the connecting sections;

wherein said housing includes a mating tongue on which both the connecting section and the heat fin are mounted; and wherein a metallic reinforcement plate mounted upon the mating tongue opposite to the connecting section.

9. An electrical connector comprising:

an insulative housing including a base and a mating tongue extending forwardly therefrom in a front-to-back direction;

a plurality of contacts disposed in the housing with contacting sections exposed upon the mating tongue and connecting legs exposed outside of the housing; and a heating device embedded within the housing and including a heating fin located adjacent to the contacting sections to heat the contacting sections and remove moisture therefrom;

wherein the heating fin is spaced from the contacting sections in a vertical direction perpendicular to said front-to-back direction;

wherein the mating tongue defines opposite first and second surfaces thereon in the vertical direction, the contacting sections are exposed upon the first surface and a metallic reinforcement plate is located upon the second surface, and the heating fin is essentially positioned upon the second surface and coplanar with the reinforcement plate;

wherein the reinforcement plate defines a recession to receive said heating fin;

wherein said heating device includes a pair of connecting legs exposed outside of the housing beside the connecting sections of the contacts; and wherein the connecting legs and the connecting sections are arranged in one row in a transverse direction perpendicular to both said front-to-back direction and said vertical direction.

* * * * *